United States Patent [19]

Ullrich

[11] 4,046,641

[45] Sept. 6, 1977

[54] PROCESS AND APPARATUS FOR THE SEPARATION OF CRUDE BENZOL AND NAPHTHALENE FROM WASHING OIL

[75] Inventor: Hansjürgen Ullrich, Bochum-Wattenscheid, Germany

[73] Assignee: Dr. C. Otto & Comp. G.m.b.H., Bochum, Germany

[21] Appl. No.: 557,829

[22] Filed: Mar. 12, 1975

[30] Foreign Application Priority Data

Mar. 19, 1974 Germany ..... 2413029

[51] Int. Cl.[2] ..... B01D 3/16

[52] U.S. Cl. ..... 203/39; 203/69; 203/83; 203/96; 203/42; 208/344; 260/674 R; 260/674 N

[58] Field of Search ..... 260/674 N, 674 R; 208/340, 341, 344; 203/96–98, 76, 83, 39, 42, 69, DIG. 19, 99; 202/234

[56] References Cited

U.S. PATENT DOCUMENTS

| | | | |
|---|---|---|---|
| 1,916,349 | 7/1933 | Van Ackeren | 203/98 |
| 2,129,787 | 9/1938 | Schmalenbach | 260/674 R |
| 2,405,393 | 8/1946 | Atkins | 203/98 |
| 2,472,810 | 6/1949 | Denig | 208/341 |
| 2,611,739 | 9/1952 | Otto | 203/96 |
| 2,649,404 | 8/1953 | Reynolds | 208/341 |
| 2,713,023 | 7/1955 | Irvine | 203/76 |
| 2,785,114 | 3/1957 | Schmalenbach | 203/96 |
| 2,913,374 | 11/1959 | Van Ackeren et al. | 208/341 |
| 3,312,749 | 4/1967 | Hess et al. | 260/674 R |

OTHER PUBLICATIONS

Benzoles Production And Uses: Claxton, 1961 pp. 235, 236, 240–246, 253, 261, 262, 268, 269, 292, 300, 301, 302.

*Primary Examiner*—Wilbur L. Bascomb, Jr.
*Attorney, Agent, or Firm*—Brown, Murray, Flick & Peckham

[57] ABSTRACT

A process and apparatus for the regeneration of washing oil which has been spent to recover naphthalene and/or benzol from coke oven gas. The spent washing oil is stripped by steam in a bubble column arranged as an integral part of a single main column that includes first, second and third exchange column sections disposed in a superimposed relation one above the other to receive the stripped vapors from the bubble column. The first exchange column section is fed with a mixture of toluene, xylene and naphthalene as a reflux, the second exchange column section is fed with water as the reflux and the third exchange column section is fed with benzol as the reflux. The head product from the column is condensed and passed through a first-phase separator to obtain a substantially anhydrous benzol fraction and a water fraction. These fractions are separately used as a reflux for the second and third exchange column sections. The liquid mixture drawn off from the second exchange column section is separated in a second-phase separator into a water phase and into a substantially anhydrous toluene-xylene-naphthalene phase. The latter is resolved by steam distillation in a secondary column having stripping and rectifying sections for resolving into a toluene-xylene fraction and a naphthalene fraction.

3 Claims, 1 Drawing Figure

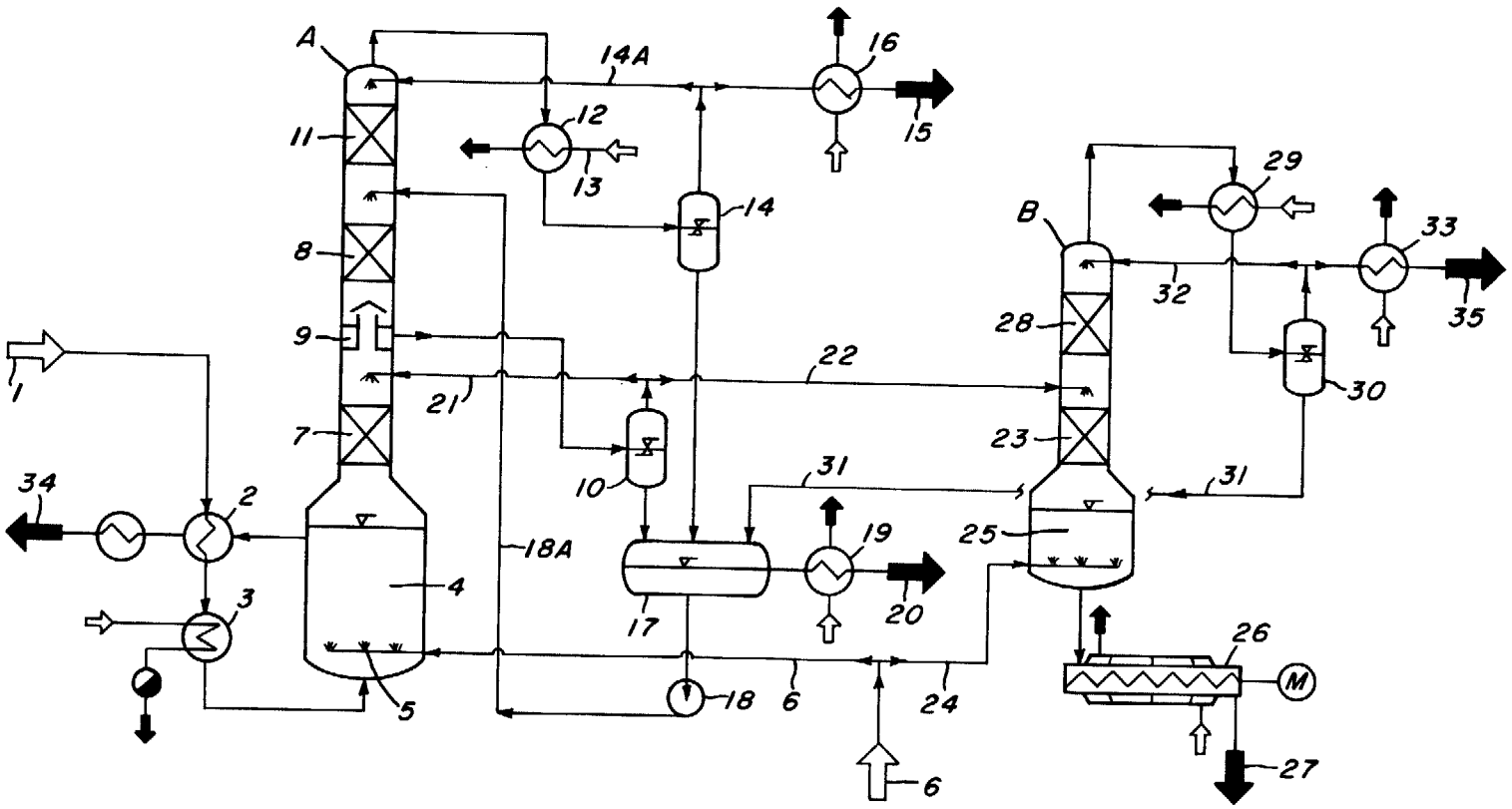
1
2
3
4
5
6
7
8
9
10
11
12
13
14
14A
15
16
17
18
18A
19
20
21
22
23
24
25
26
27
28
29
30
31
32
33
34
35
A
B
M

PROCESS AND APPARATUS FOR THE SEPARATION OF CRUDE BENZOL AND NAPHTHALENE FROM WASHING OIL

BACKGROUND OF THE INVENTION

This invention relates to a process and apparatus for separating crude benzol and naphthalene from washing oil, and more particularly, to regenerating washing oil which has been spent to recover naphthalene and/or benzol from coke oven gas wherein the washing oil is regenerated by using steam to strip it of its volatile constituents to thereby enable resolving the volatile constituents into a number of fractions.

The crude gas occurring in the process of coking of coal contains, in addition to other substances, naphthalene and various hydrocarbons, particularly benzol, toluene and xylene which are grouped under the general designation of crude benzol. Naphthalene and crude benzol must be removed before the coke oven gas is put to further use. Naphthalene and crude benzol are removed usually by scrubbing the crude gas with washing oil which absorbs the naphthalene and crude benzol. It is known in the art to recover the naphthalene and crude benzol contained in the spent washing oil by distillation to thereby enable the reuse of the washing oil in the washing cycle. Distillation of the readily volatile components is effected with steam in order to avoid excessive oil temperatures and possible thermal damage to the oil during the distillation process.

The known processes for the regeneration of washing oil by means of steam usually yield two fractions, namely, the crude benzol, which contains all the hydrocarbons and other substances more volatile than naphthalene and naphthalene oil. The naphthalene oil is a mixture of naphthalene and washing oil with crude benzol fractions. Thus, on the one hand, there are considerable washing oil losses; while on the other hand, both fractions contain the required constituents, for example, benzol and naphthalene but in highly contaminated forms so that their sale value is reduced.

SUMMARY OF THE INVENTION

It is an object of the present invention to provide a process for the regeneration of washing oil by a process requiring lower power consumption than known processes and by a process in which the washing oil losses are reduced and the yields from the process are purer and more valuable end products.

It is a further object of the present invention to provide an apparatus for the regeneration of washing oil used in the recovery of naphthalene and crude benzol from coke oven gas and wherein the apparatus includes superimposed exchange column sections arranged above a stripping column section while contained within a single housing forming a main column.

In the present invention, spent washing oil by recovering naphthalene and/or benzol from coke oven gas is regenerated by a process which includes stripping the volatile constituents from the washing oil by means of steam and then resolving the volatile constituents stripped by the steam into a number of fractions by a process which includes feeding the mixture of steam and volatile hydrocarbons formed by the passage of steam through the washing oil through at least two exchange columns before the head product is condensed and feeding the two exchange columns with different media as the reflux.

In the preferred embodiment of the present invention, the vapor mixture formed by the passage of steam through the washing oil is fed through three series-connected exchange columns, feeding the first exchange column with a mixture of toluene, xylene and naphthalene as the reflux, feeding the second exchange column with water as the reflux, and feeding the third exchange column with benzol as the reflux. Under these conditions, the washing oil entrained with the vapor mixture is exchanged for toluene, xylene and naphthalene in the first exchange column, the vapor mixture is cooled intensively in the second exchange column by evaporating refluxed water which water is particularly insoluble in the hydrocarbons, and under these particular conditions, the naphthalene precipitates extensively and can be withdrawn in a liquid state together with the likewise condensing toluene and xylene. Finally, it is mainly steam that condenses in the third exchange column which is fed with benzol as the reflux. The third exchange column receives a vapor mixture consisting of banzol and steam and at the head of this exchange column substantially pure benzol is obtained which only contains impurities having approximately the same boiling point characteristics.

According to another feature of the present invention, the head product from the main column is then condensed in a condenser and fed to a first-phase separator where benzol and water are separated by their difference in density. A liquid mixture is withdrawn from the second exchange column and this mixture is similarly separated into water and a toluene-xylene-naphthalene fraction in a second-phase separator. According to another feature of the present invention, the distillation fractions obtained, i.e., benzol, water and the toluene-xylene-naphthalene fraction, are partially used as a reflux for the exchange columns and partially discharged as end products of the process. Thus, according to the present invention, the water obtained from the first and second phase separators is used partially as a reflux for the water fed exchange column, the toluene-xylene-naphthalene mixture obtained from the second-phase separator is used partially as a reflux for the first exchange column and the substantially anhydrous benzol obtained from the first-phase separator is partially used as a reflux for the third exchange column.

The process according to the present invention is improved by feeding the toluene-xylene-naphthalene mixture obtained from the second-phase separator into a secondary column having stripping and rectifying sections. Steam is fed into the bottom of the secondary column. In the stripping section at the bottom of the secondary column, the rising vapor mixture strips off the readily-volatile hydrocarbons, preferably toluene and xylene, so that substantially pure naphthalene is obtained at the bottom of the secondary column. According to the present invention, this naphthalene is cooled and discharged from the process in solid form. The more highly volatile products as compared with the lower volatile naphthalene condense in the rectifying section at the top of the secondary column. The rectifying section according to the invention is fed with a mixture of toluene-xylene as the reflux so that a mixture of water, toluene and xylene vapor can be withdrawn from the head of this secondary column. According to another feature of the present invention, the mixture of water, toluene and xylene vapor is, in turn, condensed and fed to a third-phase separator wherein hydrocarbons and water are separated. The toluene-xylene mixture is partially returned to the rectifying section of the secondary column as a reflux and part of the toluene-xylene mixture is discharged from the process as the end product. The water from the third-phase separator is also discharged from the process.

According to the present invention, the stripping columns which are fed with steam for stripping off the volatile constituents from the washing oil and the exchange columns fed with the toluene-xylene-naphthalene mixture, water and benzol, are combined to form a unitary structure forming the main column of an apparatus for performing the process. In this apparatus, the exchange columns are disposed one above the other. The subsequent resolution of the toluene-xylene-naphthalene mixture by steam into a toluene-xylene fraction and a naphthalene fraction is separately effected by the use of a secondary column. The individual exchange columns may be constructed as packed columns or plate columns. The stripper for the washing oil which is fed with steam may also be constructed as a packed column or a plate column. In many cases, however, the washing oil throughput rate is very high in relation to the steam demand and in that case, a bubble-type column proves to be very advantageous for the stripping of the washing oil.

These features and advantages of the present invention as well as others will be more readily understood when the following description is read in light of the accompanying drawing wherein one exemplified embodiment of the apparatus and system is shown for performing the process to regenerate washing oil according to the present invention.

Spent washing oil which is charged with crude benzol and naphthalene is delivered from a naphthalene or benzol recovery plant, not shown, for regeneration by a line 1 to a heat exchanger 2. Purified oil also flows through the heat exchanger 2. The spent washing oil is then fed from the heat exchanger 2 through a steam heated heat exchanger 3 for heating the spent washing oil to a temperature of about 180° C. The spent washing oil, at this elevated temperature, enters a stripper column 4 which is constructed as a bubble column, and forms an integral part of a main column A. The volatile constituents, i.e., crude benzol and naphthalene, are stripped by steam injected into the stripper column 4 by nozzle tubes 5 that are coupled to a steam supply line 6. The resulting vapor mixture from the stripper column 4 still contains a considerable amount of washing oil. The vapor mixture from the stripper column 4 flows to an exchange column 7 wherein the oil contained in this mixture is exchanged for naphthalene. The vapor mixture passing from the exchange column section 7 still has a temperature of about 165° C and flows upwardly to a second exchange column section 8 which is arranged in a superimposed relation above the exchange column section 7. The second exchange column 8 is fed with water whereby the vapor mixture is cooled to about 100° C. The liquid mixture conducted away from this second exchange column section consists of a mixture of water and a toluene-xylene-naphthalene mixture. This liquid mixture is collected in a collecting cup 9 and fed to a secondary phase separator 10 wherein the liquid mixture is separated into a water fraction and a toluene-xylene-naphthalene fraction.

The vapor mixture passing from the second exchange column section 8 being cooled to a temperature of approximately 100° C flows upwardly to a third exchange column section 11 which is arranged in a superimposed relation above the second exchange column section 8. The third exchange column section 11 is fed with benzol whereby the water, toluene and xylene are exchanged in this section for benzol. The heat product passing from the main column A consists essentially of benzol and water. The head product is condensed in a condenser 12 into which cooling water is fed by line 13. The condensed head product is fed to a phase separator 14. Anhydrous benzol is conducted from the phase separator 14 by a line 14A which is divided so that some of the anhydrous benzol serves as a reflux conducted by the line 14A to the third exchange column section 11. The remaining portion of the anhydrous benzol is passed through a heat exchanger 16 for further cooling and fed therefrom by line 15 as an end product of the process. The accumulating water in the phase separators 10 and 14 is collected in a collecting tank 17. Some of the water in tank 17 is recycled to the second exchange column section 8 through the use of pump 18 coupled to line 18A. The remaining portion of the water in collecting tank 17 is subjected to further cooling in a heat exchanger 19 from which cooled water is discharged from the plant by line 20. The regenerated and stripped washing oil is conducted from the main column A by a line 34. This stripped washing oil is returned, if desired, to the naphthalene or benzol recovery plant.

The phase separator 10 yields in addition to water, an anhydrous toluene-xylene-naphthalene fraction and a portion of this fraction is fed via line 21 as a reflux to the first exchange column section 7. the remaining portion of the anhydrous toluene-xylene-naphthalene fraction is fed via line 22 to a secondary column B for further processing by distillation. The secondary column B includes a stripping column 23 which is fed with steam via line 24 to strip the anhydrous toluene-xylene-naphthalene fraction into readily-volatile constituents, namely, toluene and xylene. Pure naphthalene forms the less volatile constituent and it collects in the bottom 25 of the secondary column. The pure naphthalene is cooled and discharged in solid form by line 27. In the exemplified embodiment of the present invention, cooling of the pure naphthalene is carried out in a cooling device constructed as a scraper cooler 26. It will be understood that other devices, for example, cooling rollers may be used instead of the scraper cooler 26.

In the secondary column B, the vapor mixture, i.e., toluene and xylene, enters the stripper column 23 and then passes through a rectifying section 28 which also receives a toluene-xylene mixture as the reflux so that the head product of the secondary column B is substantially free of naphthalene. The head product is drawn off and condensed in the condenser 29 from where the condensed product is then fed to a phase separator 30. Line 31 conducts water separated from the condensed product by separator 30 to the collecting tank 17. The anhydrous toluene-xylene mixture from the phase separator 30 is conducted in partial quantities by line 32 for use as a reflux for the rectifying section 28. Part of the anhydrous toluene-xylene mixture is passed through a heat exchanger 33 and discharged by line 35 as an end product of the process.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In a process to regenerate washing oil which has been spent during the recovery of naphthalene and benzene from coke oven gas and wherein said spent washing oil is then stripped of volatile constituents with steam to thereby enable resolving the volatile constituents into a number of fractions, said process comprising:

treating a vapor mixture consisting essentially of steam and volatile hydrocarbons, formed as the products of passing steam through said washing oil, by feeding said mixture into the lowermost one of a succession of at least two superimposed and serially-connected exchange in columns in vapor flow communications, refluxing the first of said serially-connected exchange columns with a mixture of toluene, xylene and naphthalene, feeding the second of said serially-connected exchange columns with water as the reflux, recovering an overhead product from the uppermost exchange column of said succession of at least two exchange columns, condensing said overhead product, separating said condensed overhead product in a first phase separator into an essentially water-free benzene fraction and a water fraction, collecting the resulting liquid mixture from the lower portion of the second of said serially-connected exchange columns, and separating said resulting liquid mixture in a second phase separator into an essentially water-free toluene-xylene-naphthalene phase and a water fraction.

2. In a process to regenerate washing oil which has been spent to recover naphthalene and benzene from coke oven gas and wherein the washing oil is stripped of volatile constituents with steam to thereby enable resolving the volatile constituents into a number of fractions, said process comprising:

treating a vapor mixture essentially consisting of steam and volatile hydrocarbons formed as the products of passing steam through said washing oil by feeding such a mixture through a succession of three superimposed and serially-connected exchange columns, refluxing the first of said serially-connected exchange columns with a mixture of toluene, xylene and naphthalene, feeding the second of said serially-connected exchange columns with water as the reflux, refluxing the third of said serially-connected exchange columns with benzene, recovering an overhead product from the third and uppermost exchange column of said three exchange columns, condensing said overhead product, separating said condensed overhead product in a first phase separator into an essentially water-free benzene fraction and a water fraction, collecting the resulting liquid mixture from the lower portion of the second of said serially-connected exchange columns, and separating said resulting liquid mixture in a second phase separator into an essentially water-free toluene-xylene-naphthalene phase and a water fraction.

3. The process according to claim 2 further comprising charging said essentially water-free toluene-xylene-naphthalene phase separated by said second phase separator into a secondary column having stripping and rectifying sections for separation by water vapor distillation into a toluene-xylene fraction and a naphthalene fraction, and refluxing the rectifying section of said secondary column with an essentially water-free toluene-xylene mixture.

* * * * *